United States Patent [19]

Morris

[11] 4,285,437

[45] Aug. 25, 1981

[54] PUSH BUTTON CHILD-RESISTANT CAP FOR CONTAINERS

[76] Inventor: Glenn H. Morris, 4203 Highwood Dr., Chattanooga, Tenn. 37415

[21] Appl. No.: 169,840

[22] Filed: Jul. 17, 1980

Related U.S. Application Data

[63] Continuation-in-part of Ser. No. 74,780, Sep. 12, 1979, Pat. No. 4,223,794.

[51] Int. Cl.[3] ..... B65D 55/02

[52] U.S. Cl. ..... 215/220; 215/206

[58] Field of Search ..... 215/219, 220, 206

[56] References Cited

U.S. PATENT DOCUMENTS

| | | | |
|---|---|---|---|
| 3,520,435 | 7/1970 | McIntosh | 215/220 |
| 3,710,970 | 1/1973 | Elfline | 215/219 X |
| 3,756,444 | 9/1973 | McIntosh | 215/220 |
| 4,223,794 | 9/1980 | Morris | 215/220 |

*Primary Examiner*—George T. Hall

*Attorney, Agent, or Firm*—Brady, O'Boyle & Gates

[57] ABSTRACT

A closure cap for containers of harmful products when rotationally tightened on the threaded container neck becomes freewheeling in the opposite direction of rotation and resistant to opening by a child. Indicator elements on the inner and outer cap components can be aligned to locate a push button of the outer cap component at a depressable position where a driving element thereof can engage an unscrewing abutment of the inner cap component. The two cap components have initial and final tightening abutments which are sequentially engaged during tightening rotation. The inner cap component has a ramp which coacts with the push button to elevate the push button above all abutment surfaces of the inner cap component during freewheeling of the outer cap component in the child-resistant mode.

13 Claims, 20 Drawing Figures

FIG. 1
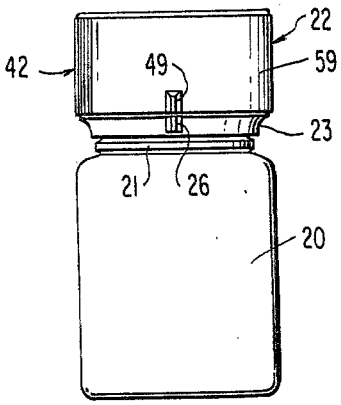
FIG. 3
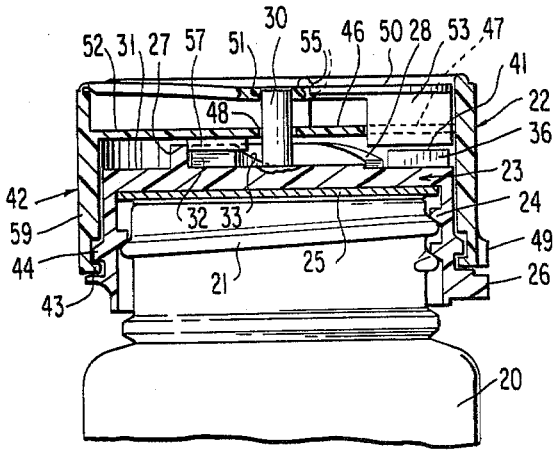
FIG. 2
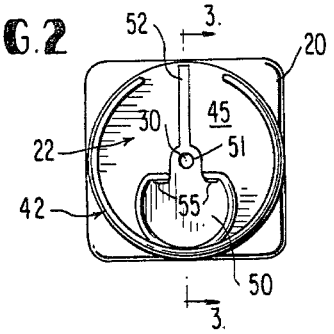
FIG. 7A
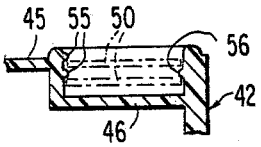
FIG. 4
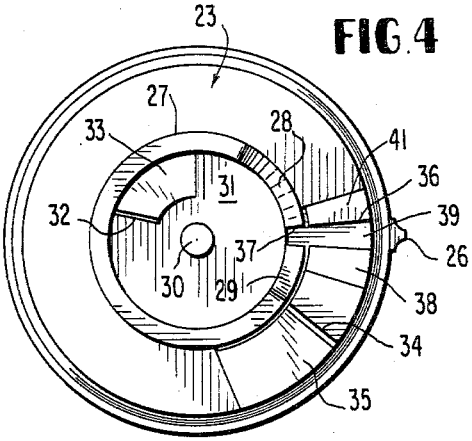
FIG. 6
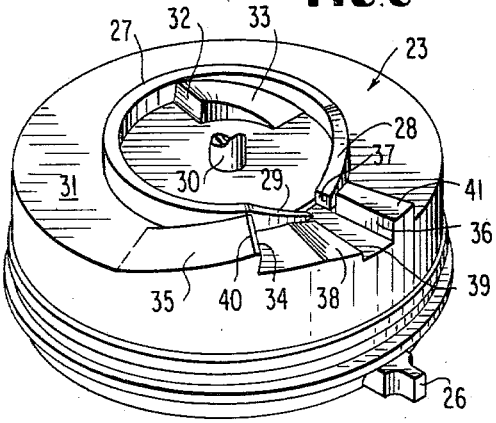
FIG. 5
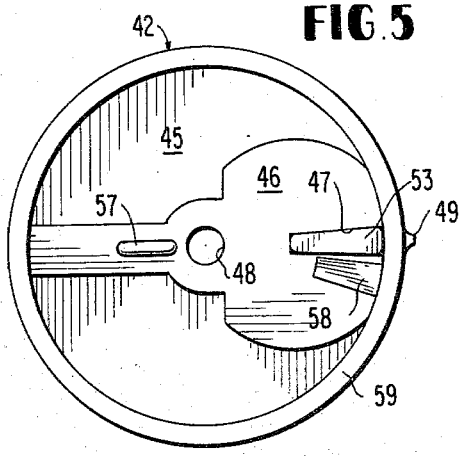
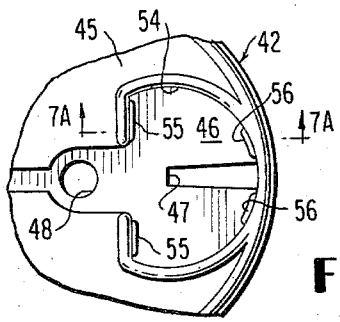
FIG. 7

PUSH BUTTON CHILD-RESISTANT CAP FOR CONTAINERS

CROSS-REFERENCE TO RELATED APPLICATION

This application is a continuation-in-part of prior copending application Ser. No. 074,780, filed Sept. 12, 1979, for PUSH BUTTON SAFETY CAP FOR GLASS BOTTLES, now U.S. Pat. No. 4,223,794.

BACKGROUND OF THE INVENTION

The objective of the present invention is to improve the operational efficiency and reliability of a child-resistant push button closure cap for containers of the general type disclosed in the referenced prior patent application. More particularly, the present invention seeks to render the closure cap more compatible with plastics molding techniques and to render the closure cap components more dimensionally stable and precise in their manufactured forms.

A further objective is to provide a closure cap for medicine containers and containers of other harmful products which will indicate to a viewer of the closure cap whether it is in a child-resistant or non-child-resistant mode.

Another objective is to provide a closure cap of the mentioned type having a push button release element which responds to very light finger pressure, thereby rendering the closure cap easy to operate by the elderly.

An important object and feature of the invention resides in an arrangement whereby the closure cap is tightened in two stages, and the momentum developed in the first stage of tightening is used to assist in the second or final stage of tightening.

A further object is to provide a closure cap of the mentioned type which can be closed or sealed with two degrees of tightness, and in either case will effectively seal a liquid in the container. In the first or lesser degree of tightness, however, the closure cap will not be safe or child-resistant, as it will be in the fully tightened condition.

Another object is to provide a push button child-resistant closure cap which can be conveniently operated by the blind.

Other objects and advantages of the invention will become apparent during the course of the following description.

BRIEF DESCRIPTION OF THE DRAWINGS

FIG. 1 is a side elevation of a container and closure cap according to the present invention.

FIG. 2 is a plan view thereof.

FIG. 3 is an enlarged central vertical section taken on line 3—3 of FIG. 2.

FIG. 4 is a plan view of an inner cap component.

FIG. 5 is a bottom plan view of an outer cap component.

FIG. 6 is a perspective view of the inner cap component shown in FIG. 4.

FIG. 7 is an enlarged fragmentary plan view of the outer cap component showing push button detent means.

FIG. 7*a* is a fragmentary vertical section taken on line 7*a*—7*a* of FIG. 7.

DETAILED DESCRIPTION

Figure 8:
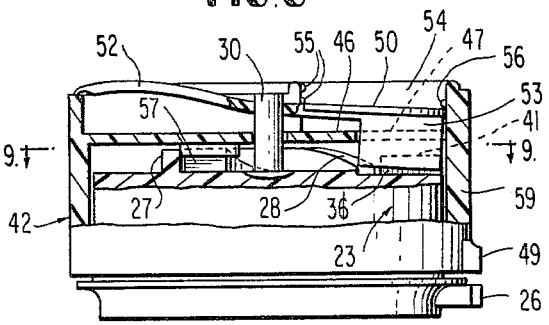
FIG. 8 is a vertical section similar to FIG. 3, parts in elevation, with the push button depressed in preparation for unscrewing the closure cap.

Referring to the drawings in detail wherein like numerals designate like parts and referring first to FIGS. 1 through 7*a*, the numeral 20 designates a container, such as a glass medicine bottle, having a conventionally screw-threaded neck 21 formed thereon. The numeral 22, FIGS. 1 and 3, designates a push button child-resistant closure cap in its entirety adapted to be molded from plastics material. The closure cap 22 comprises an inner cap section or component 23 having internal screw-threads 24 to engage the threads of the container neck and having the usual interior disc seal 25 to compressively engage the mouth of the container neck. The inner cap component 23 carries a preferably pointed radial indicator element 26 near its lower end and projecting somewhat beyond its periphery.

On its top, the inner cap component 23 is provided with an upstanding annular ramp 27 of considerably lesser diameter than the body of the cap component 23 and being concentric therewith. The ramp 27 has inclined terminals 28 and 29. A center post 30 is fixed to the top wall 31 of cap component 23 and rises therefrom to a point well above the annular ramp 27.

Immediately inwardly of the annular ramp 27, inner cap component 23 carries a fixed radial first stage cap tightening abutment face 32 having a tapered ramp surface 33 leading downwardly therefrom to the plane of top wall 31. The ramp surface 33 extends circumferentially of the cap component 23 for about 70 degrees, FIG. 4. The abutment surface 32 is approximately opposite diametrically from the indicator element 26 although this relationship is not required.

Outwardly of the annular ramp 27, a fixed steeply inclined final stage tightening abutment shoulder 34 or surface rises from the top wall 31 and is joined therewith by a gradually inclined ramp surface 35. The surface 34 extends radially of cap component 23, and forms an included angle of approximately 160 degrees with the abutment surface 32. A radial cap unscrewing abutment surface 36 rises from the top wall 31 in spaced relationship to surface 34 and in radial alignment with the end face 37 of ramp 28, FIG. 4.

Figure 9:
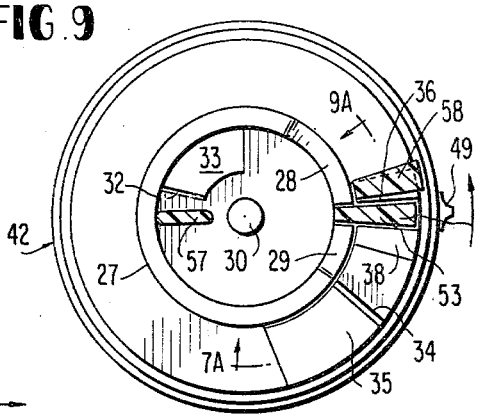
FIG. 9 is horizontal section taken on line 9—9 of FIG. 8.
Figure 9A:
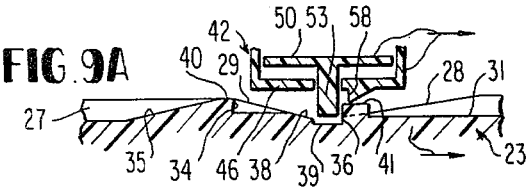
FIG. 9*a* is a fragmentary developed section taken on line 9*a*—9*a* of FIG. 9.

Another inclined ramp surface 38 is formed on the cap component 23 between abutment surfaces 36 and 34 and the degrees of inclination of ramp surfaces 29 and 38 are the same and these surfaces lie in a common plane, as best shown in FIG. 9*a*. A shallow recess 39 exists between ramp surface 38 and abutment surface 36, FIG. 9*a*. The two surfaces 34 and 36 are separated circumferentially approximately 30 degrees, FIG. 4.

The top edge 40 of final tightening abutment surface 34 is somewhat above the top surface 41 of the lug or projection having the abutment surface 36.

The closure cap 22 further comprises an outer cap section 42 or component telescoped over the inner cap section 23, FIG. 3, and having swiveled engagement therewith. The two cap sections are held in assembled relationship by interengaging annular flanges 43 and 44. The outer cap section 42 includes a top wall 45 including a depressed roughly semi-circular wall portion 46 having a radial slot 47. The depressed wall portion 46 has an aperture 48 disposed at the center of the closure cap through which post 30 projects. The top wall 45 may carry thereon molded operational instructional indicia, not shown.

The outer cap section 42 carries a pointed indicator element 49 at its lower edge adapted for alignment with the element 26 of the inner cap section when the release of the closure cap is desired, as will be further explained. The element 49 is preferably in the same radial plane as the slot 47, FIG. 5.

The outer cap section 42 is equipped with a push button tab 50 having an aperture 51 to receive the top of post 30. Push button tab 50 is preferably, although not necessarily, integrally connected with cap section 42 by a narrow hinge web 52 which is flexible. The push button tab carries depending radial drive lug 53 which is received through the slot 47 so as to project below the wall portion 46 when the push button tab is depressed, FIG. 8. Push button tab 50 and lug 53 are then somewhat inclined, as shown. Within the well 54 formed around depressed wall portion 46 pairs of rear push button detents 55 and a single pair of forward detents 56 are formed for the control of push button tab 50 with a snap action so that once the tab is depressed by the finger, it does not have to be held down during closure cap unscrewing. Likewise, in closure cap tightening, when the push button tab pops up in a manner to be further described, the detent means 55–56 positions the push button tab in a constrained manner in its raised position. The push button tab 50 is shown in phantom lines in FIG. 7*a* in the depressed and raised positions.

On the bottom of depressed wall portion 46, the outer cap section 42 has a first stage radial cap tightening rib 57 near the aperture 48, FIG. 5. A second and final stage cap tightening lug 58 is similarly formed on the bottom of depressed wall portion 46 and is radially disposed immediately inwardly of the peripheral wall 59 of the outer cap section. The two elements 57 and 58 are separated circumferentially by an included angle of roughly 165 degrees, FIG. 5.

FIGS. 8 through 9*a* illustrate the closure cap unscrewing operation and FIGS. 11 through 13*b* illustrate the two stage closure cap tightening operation. Referring first to FIGS. 8 through 9*a* and assuming that the closure cap has previously been fully tightened and is in the child-resistant state where the outer cap section 42 is freewheeling in the unscrewing direction shown by the directional arrows in these figures, the following takes place. The outer cap section 42 is turned in the unscrewing direction until the two indicator elements 26 and 49 are in alignment axially of the closure cap. In such relative positions, the user can now depress the push button tap 50 with a finger and the depending lug 53 can move downwardly as shown to a position in the recess 39 with which the lug is now aligned. In this position, the lug is adjacent to the abutment surface 36 on the inner cap section 23. As best shown in FIG. 8, detents 55 and 56 will retain the push button tab 50 and its lug 53 in the depressed position. The user now rotates the outer cap section 42 in the unscrewing direction shown by the arrows in FIGS. 9 and 9*a* and one side of the lug 53 will contact the unscrewing abutment face 36 of the inner cap section 23 and both cap sections as a unit can be unscrewed and removed from the neck of the container 20.

Figure 10:
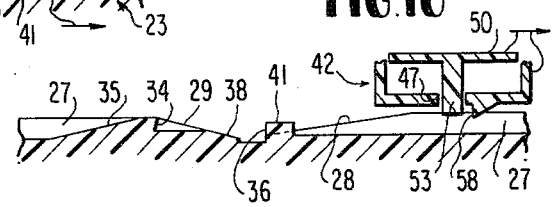
FIG. 10 is a view similar to FIG. 9*a* showing the corresponding part in a further operational stage of cap release.

FIG. 10 shows the outer cap section 42 freewheeling in the unscrewing direction as will be the case where the closure cap is fully tightened and the push button tab 50 is not yet depressed by the finger while indicator elements 26 and 49 are aligned. During such freewheeling, push button tab 50 is held elevated by the riding action of the lug 53 on top of the annular ramp 27 and the added control action of detent means 55 and 56.

Figure 11:
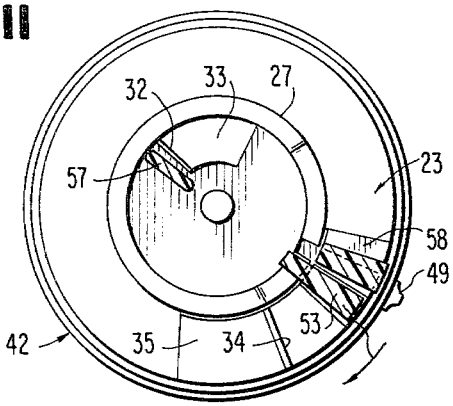
FIG. 11 is a view similar to FIG. 9 illustrating the beginning of cap tightening.
Figure 11A:
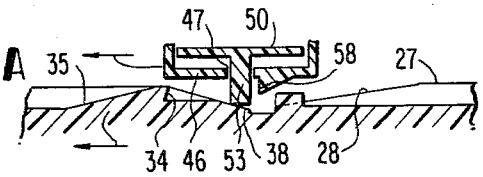
FIG. 11*a* is a view similar to FIG. 9*a* and showing the beginning of cap tightening as in FIG. 11.

Referring to FIGS. 11 through 13*b* showing the two stage cap tightening operation, FIG. 11 shows the beginning of the first stage of tightening where the user has re-applied the two cap sections to the container neck and has begun to rotate the outer cap section 42 in the tightening direction shown by the directional arrow. The first stage tightening rib 57 of outer cap section 42 is approaching the first stage tightening abutment face 32 of the inner cap section 23 but has not yet contacted such surface. As shown in FIG. 11*a*, the push button lug 53 is beginning to climb the inclined ramp 38 as the inner cap section gradually encounters frictional resistance on the neck of the container. Initially, in the tightening process, the two cap sections, due to the friction of the engagable cam surfaces 29,38 and that on the lug 53, and the resistance of the lower detents 55 and 56, rotate as a unit until the inner cap section 23 begins to encounter frictional resistance on the neck of the container. As this frictional resistance builds up, the two cap sections begin to have relative movement because the progress of the inner cap section will be retarded whereas the outer cap section can still turn freely in the tightening direction.

Figure 12:
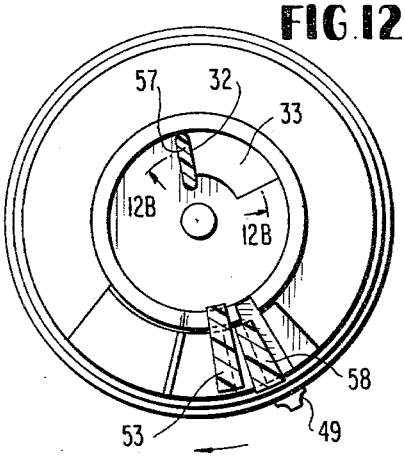
FIG. 12 is a further view similar to FIG. 9 showing the elements in the first stage of cap tightening actively engaged.
Figure 12B:
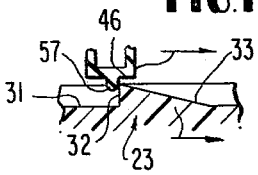
FIG. 12*b* is an enlarged fragmentary developed section taken on line 12*b*—12*b* of FIG. 12.

In FIGS. 12 and 12*b*, the first stage tightening rib 57 of the outer cap section has positively engaged the first stage abutment surface 32 of the inner cap section 23. Further tightening rotation of the closure cap by the user will complete the first stage of tightening. At this point, the closure cap is liquid-tight on the container but is not child-resistant, as the push button tab 50 and lug 53 are still depressed.

Figure 12A:
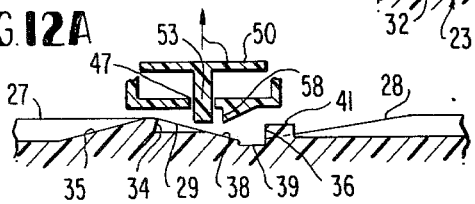
FIG. 12*a* is a view similar to FIG. 9*a* depicting the ascent of the push button during the cap tightening cycle.
Figure 13:
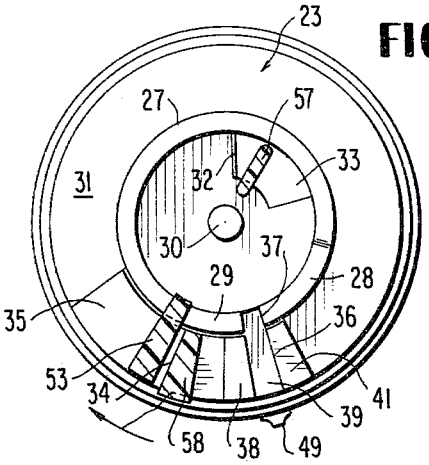
FIG. 13 is a further view similar to FIG. 9 showing the beginning of the final stage of cap tightening.
Figure 13B:
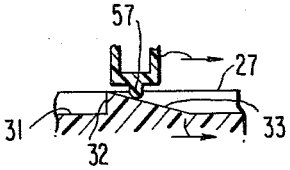
FIG. 13*b* is a view similar to FIG. 12*b* following override and release of the first stage tightening parts on the two cap components.

Still further tightening by the user will overcome the resistance of the abutment surface 32 against the rib 57 and the rib will escape and snap over the abutment and move on to a position such as illustrated in FIG. 13*b*. Substantially simultaneously with this escapement, the pressure of the ramp surface 29 on the push button lug 53 will cause the push button to escape or snap over the lower detents 55 and 56, FIG. 7*a*, and pop up to the child-resistant position as indicated by the arrow in FIG. 12*a*. The top detent 55 constrains the push button tab in this upper child-resistant position where the unscrewing lug 53 is above the level of the unscrewing abutment surface 36.

Figure 13A:
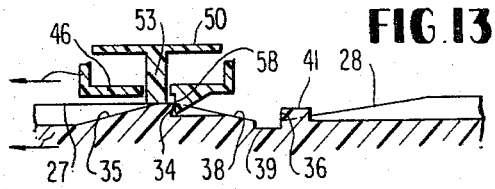
FIG. 13*a* is a view similar to FIG. 9*a* showing full engagement of the parts involved in final cap tightening while the push button remains elevated.

Substantially simultaneously with the above escapement of the rib 57 from the abutment surface 32 and the popping up of the push button tab 50, the second and final stage of the cap tightening process commences by the engagement of second stage tightening lug 58 of the outer cap section with the second stage abutment shoulder 34 of the inner cap section, as best shown in FIG. 13*a*. An important feature of the invention resides in the utilization of the turning inertia developed in the first stage of tightening to complete the second and final stage. When the rib 57 escapes over the abutment surface 32 at the end of the first stage of tightening, further turning effort by the user will cause the lug 58 to slam into the abutment shoulder 34 almost instantly and without any slowing down of the tightening process, thus taking advantage of inertia developed in the process.

At the completion of closure cap tightening where the screw-threads 21 offer firm resistance to any further manual rotation of the cap, the container is tightly sealed and child-resistant, in that the outer cap section 23 is freewheeling in the unscrewing direction. This is due to the fact that the push button lug 53 is now riding on top of the annular ramp 27.

Only after the user re-aligns the two indicator elements 26 and 49 and depresses the push button tab 50, thus returning the parts to the relative positions shown in FIG. 9*a*, can the closure cap be removed in the manner described relative to FIGS. 8 through 9*a*.

The described arrangement provides a foolproof, child-resistant closure cap which is very easy to operate by elderly adults because it requires little physical effort to operate the push button and to twist the outer cap section 42 through the two stages of tightening and the subsequent unscrewing operation. The stated objectives of the invention are achieved in a cap structure which is economical and fully practical from a manufacturing standpoint. A user of the container can see at a glance whether the cap is in a child-resistant or unsafe state.

It should be pointed out that the engagement of the post 30 in the push button aperture 51, together with the action of detent elements 55, forms a horizontal axis fulcrum for the push button tab 50 in its movement between two positions shown in FIGS. 3 and 8.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. A push button child-resistant closure cap for containers comprising an inner cap section which is screw-threaded for engagement with container screw-threads and an outer cap section which has a swiveled connection with the inner cap section, the inner and outer cap sections having alignable indicator elements thereon, the inner cap section having circumferentially spaced first and second stage tightening abutment surfaces and an unscrewing abutment surface which is circumferentially spaced from said first and second stage abutment surfaces, the inner cap section having a ramp including inclined surfaces ascending from a region of the inner cap section near the second stage tightening abutment surface and the unscrewing abutment surface, the outer cap section having circumferentially spaced first and second stage tightening lugs thereon adapted to engage said first and second stage tightening abutment surfaces in response to relative rotation of the inner and outer cap sections during tightening rotation, and a depressable push button element on the outer cap section including a depending lug adapted to ride on said ramp and adapted when the push button element is depressed to contact said unscrewing abutment surface.

2. A push button child-resistant closure cap for containers as defined in claim 1, and snap lock detent means on the outer cap section restraining the depressable push button element releasably in depressed and raised positions, the holding power of the detent means being overcome by the pressure of said depending lug riding on one inclined surface of said ramp during closure cap tightening.

3. A push button child-resistant closure cap for containers as defined in claim 1, and the top of said unscrewing abutment surface being at a lower level on the inner cap section than the top of said ramp, said ramp being annular between said inclined surfaces thereof, the first stage tightening abutment surface of the inner cap section comprising a radial surface interiorly of the annular ramp and the second stage tightening abutment surface and the unscrewing abutment surface comprising radial surfaces exteriorly of said ramp.

4. A push button child-resistant closure cap for containers as defined in claim 1, and the first stage tightening lug of the outer cap section comprising a shallow lug adapted to escape over the top of the first stage tightening abutment surface of the inner cap section following development of a predetermined pressure between the shallow lug and said first stage abutment surface, thereby allowing the second stage tightening lug of the outer cap section to strike the second stage abutment surface of the inner cap section with momentum in the second stage tightening process for the closure cap, and the depressed push button element moving to its raised position substantially simultaneously with the escapement of said shallow lug over said first stage tightening abutment surface thereby indicating a child-resistant state for the closure cap.

5. A push button child-resistant closure cap for containers as defined in claim 1, and said push button element being disposed within a well formed in the top of the outer cap section, and the bottom wall of said well having a slot through which the depending lug of the push button element projects movably.

6. A push button child-resistant closure cap for containers as defined in claim 5, and the second stage tightening lug of the outer cap section being fixed on the lower surface of the bottom wall of said well close to one side of said slot in said bottom wall.

7. A push button child-resistant closure cap for containers as defined in claim 1, and a seal element within the inner cap section to engage and seal the mouth of a container at least when the first stage of closure cap tightening is complete.

8. A push button child-resistant closure cap for containers as defined in claim 5, and snap lock detent elements for said push button element on side wall portions of the well at two elevations.

9. A push button child-resistant closure cap for containers as defined in claim 1, and an inclined ramp surface on the top wall of the inner cap section outwardly of one inclined surface of said ramp and having the same degree of inclination and the same elevation as said one inclined surface of the ramp and being located between said unscrewing abutment surface and second stage tightening abutment surface of the inner cap section.

10. A push button child-resistant closure cap for containers as defined in claim 9, and the first and second stage tightening abutment surfaces of the inner cap section being circumferentially spaced slightly less than 180 degrees, the first and second stage tightening lugs of the outer cap section being similarly spaced on the depending lug of said push button element being closely adjacent to one side of the second stage tightening lug of the outer cap section.

11. A push button child-resistant cap for containers of harmful substances comprising inner and outer relatively rotatable interengaged cap sections, the inner cap section being screw-threaded for engagement with container screw-threads and being adapted to seal the mouth of the container, the inner cap section having circumferentially spaced first and second stage tightening abutment surfaces and an unscrewing abutment surface and having inclined ramp means on its top extending to an elevation above the top of the unscrewing abutment surface, a pair of circumferentially spaced first and second stage tightening lugs on the outer cap section adapted sequentially to engage the first and second stage tightening abutment surfaces of the inner cap section, the first stage tightening lug adapted in response to a build-up of resistance to tightening to escape over the top of the first stage tightening abutment surface, whereby the second stage tightening lug will impact with momentum on the second stage tightening abutment surface of the inner cap section, and a depressable push button element on the outer cap section including a depending drive lug adapted to engage said unscrewing abutment surface and also adapted to ride on said inclined ramp means, whereby the latter will cause the push button element to be elevated substantially at the instant of the escapement of the first stage tightening lug over the top of the first stage tightening abutment surface.

12. A push button child-resistant cap for containers comprising inner and outer relatively rotatable interengaged cap sections, the inner cap section being screw-threaded to engage container screw-threads, the inner cap section having circumferentially spaced first and second stage tightening abutment surfaces on the top thereof and an unscrewing abutment surface, a tightening lug on the outer cap section adapted to engage the first stage tightening abutment surface of the inner cap section and adapted to escape over the top of such abutment surface after a certain build-up of resistance to cap tightening, a depressable push button element on the outer cap section including a drive lug adapted to engage said unscrewing abutment surface when the push button element is depressed, and camming means on the top of the inner cap section engageable with said drive lug of the push button element to elevate the push button element substantially at the time of the escapement of said tightening lug over the top of said first stage tightening abutment surface.

13. A push button child-resistant cap for containers comprising inner and outer relatively rotatable cap sections, the inner cap section being screw-threaded to engage container screw-threads, the inner cap section having circumferentially spaced first and second stage tightening surfaces thereon and an unscrewing surface, at least one tightening lug on the outer cap section engageable at least with the first stage tightening surface of the inner cap section during relative rotation between the two cap sections, said tightening lug being adapted to escape over the first stage tightening surface following a certain build-up of resistance to cap tightening, a depressable push button element on the outer cap section including a drive lug adapted to engage the unscrewing surface of the inner cap section while the push button element is depressed to cause unscrewing of the inner cap section, and camming means on the inner cap section engageable with said drive lug to elevate the push button element during tightening rotation of the cap.

* * * * *